US006513172B1

(12) United States Patent
Norton

(10) Patent No.: US 6,513,172 B1
(45) Date of Patent: Feb. 4, 2003

(54) TOILET SPLATTER SHIELD

(76) Inventor: Robert N. Norton, 3575 Clague Rd., Unit 102, North Olmsted, OH (US) 44070

( * ) Notice: Subject to any disclaimer, the term of this patent is extended or adjusted under 35 U.S.C. 154(b) by 0 days.

(21) Appl. No.: 10/251,698

(22) Filed: Sep. 20, 2002

(51) Int. Cl.[7] ..... F15D 1/00
(52) U.S. Cl. ..... 4/300.3
(58) Field of Search ..... 4/300.3, DIG. 5

(56) References Cited

U.S. PATENT DOCUMENTS

| | | | | |
|---|---|---|---|---|
| 2,407,005 A | | 9/1946 | Haley | |
| 2,931,047 A | | 4/1960 | Stebbins | |
| 3,205,509 A | * | 9/1965 | Rose | 4/DIG. 5 X |
| 3,212,104 A | * | 10/1965 | Stevens | 4/300.3 |
| 3,350,722 A | * | 11/1967 | Moreschini | 4/300.3 |
| 3,614,790 A | * | 10/1971 | Billinggsly et al. | 4/300.3 |
| 3,723,998 A | | 4/1973 | Wehr | |
| 4,215,443 A | | 8/1980 | Babik | |
| 4,535,491 A | | 8/1985 | Young | |
| 5,005,224 A | | 4/1991 | Carmichael | |
| 6,385,784 B1 | | 5/2002 | Donohue | |

* cited by examiner

*Primary Examiner*—Charles E. Phillips
(74) *Attorney, Agent, or Firm*—Donald A. Bergquist

(57) ABSTRACT

A shield is provided for a toilet on which a seat is hinged for rotation between a down position on the rim of the toilet bowl and an up position angularly displaced from the rim of the toilet bowl. A C-shaped flat clip is adapted to grip the rim of the toilet bowl at one side thereof. The top surface of this clip is substantially flat, paralleling the top surface of the toilet rim. At the outboard edge of this clip is a hinge supporting a spring-biased lever that extends inward and downward into the bowl of the toilet, supporting on the distal end thereof a substantially strike pad for absorbing the impact of a urine stream impinging upon it, reducing noise and reducing splatter. The lever is engagable against the underside of the seat for downward displacement of the lever and thus the strike pad in response to force exerted on the lever by the underside of the seat during rotation of the seat into the down position.

5 Claims, 2 Drawing Sheets

TOILET SPLATTER SHIELD

BACKGROUND OF THE INVENTION

This invention relates generally to bathroom accessories and more particularly concerns a noise suppression shield for a typical household toilet.

When men use a typical household toilet to urinate, splattering leaves the toilet area in an unpleasant and unsanitary condition and the noise of the urine stream hitting the water surface can be obnoxious to other dwellers in the household. The noise problem is exacerbated during nocturnal visits and when visitors are in the dwelling. A shield properly positioned in the bowl could assist in noise reduction and also reduce the splatter. Such a shield, however, could not be permanently located for obvious reasons. On the other hand, the need to position or reposition the shield would introduce new problems.

It is, therefore, an object of this invention to provide a household toilet splatter shield that will reduce splatter and noise during use of the toilet by men. Another object of this invention is to provide a household toilet splatter shield that is automatically repositioned in the toilet bowl in response to the repositioning of the toilet seat. Yet another object of this invention is to provide a household toilet splatter shield that is automatically positioned in an approximately vertical use position when the seat is in an up position. It is also an object of this invention to provide a household toilet splatter shield that is automatically positioned at an approximately vertical storage position at the side of the bowl when the seat is in a down position. Still another object of this invention is to provide a household toilet splatter shield that is easily adaptable for use in variously-shaped toilets. An additional object of this invention is to provide a household toilet splatter shield and target for training male children to always lift the toilet seat when urinating in a standing position. Another object of this invention is to provide a household toilet splatter shield that is self-cleaning during the normal toilet bowl flush operation.

SUMMARY OF THE INVENTION

In accordance with the invention, a shield is provided for a toilet on which a seat is hinged for rotation between a down position on the rim of the toilet bowl and an up position angularly displaced from the rim of the toilet bowl. A C-shaped flat clip is adapted to grip the rim of the toilet bowl at one side thereof. This clip may be held in place by spring pressure, by screw clamps, or by adhesives. The top surface of this clip is substantially flat, paralleling the top surface of the toilet rim. At the outboard edge of this clip is a hinge supporting a spring-biased lever that extends inward and downward into the bowl of the toilet, supporting on the distal end thereof a substantially strike pad for absorbing the impact of a urine stream impinging upon it, reducing noise and reducing splatter. The lever is engagable against the underside of the seat for downward displacement of the lever and thus the strike pad in response to force exerted on the lever by the underside of the seat during rotation of the seat into the down position. In this non-use position, the strike pad is close to the wall of the bowl, but above the normal water level therein. When the toilet is flushed, the water level rises and rinses the strike pad while fresh flush water entering the bowl from outlets under the rim contributes to this rinsing operation. When the seat is raised, it allows the biasing means of the lever to raise the lever away from the top surface of the clip and raises the strike pad away from the wall of the bowl into a use position, where it can be easily targeted by the man or boy during urination.

DETAILED DESCRIPTION OF THE BEST MODE

Figure 1:
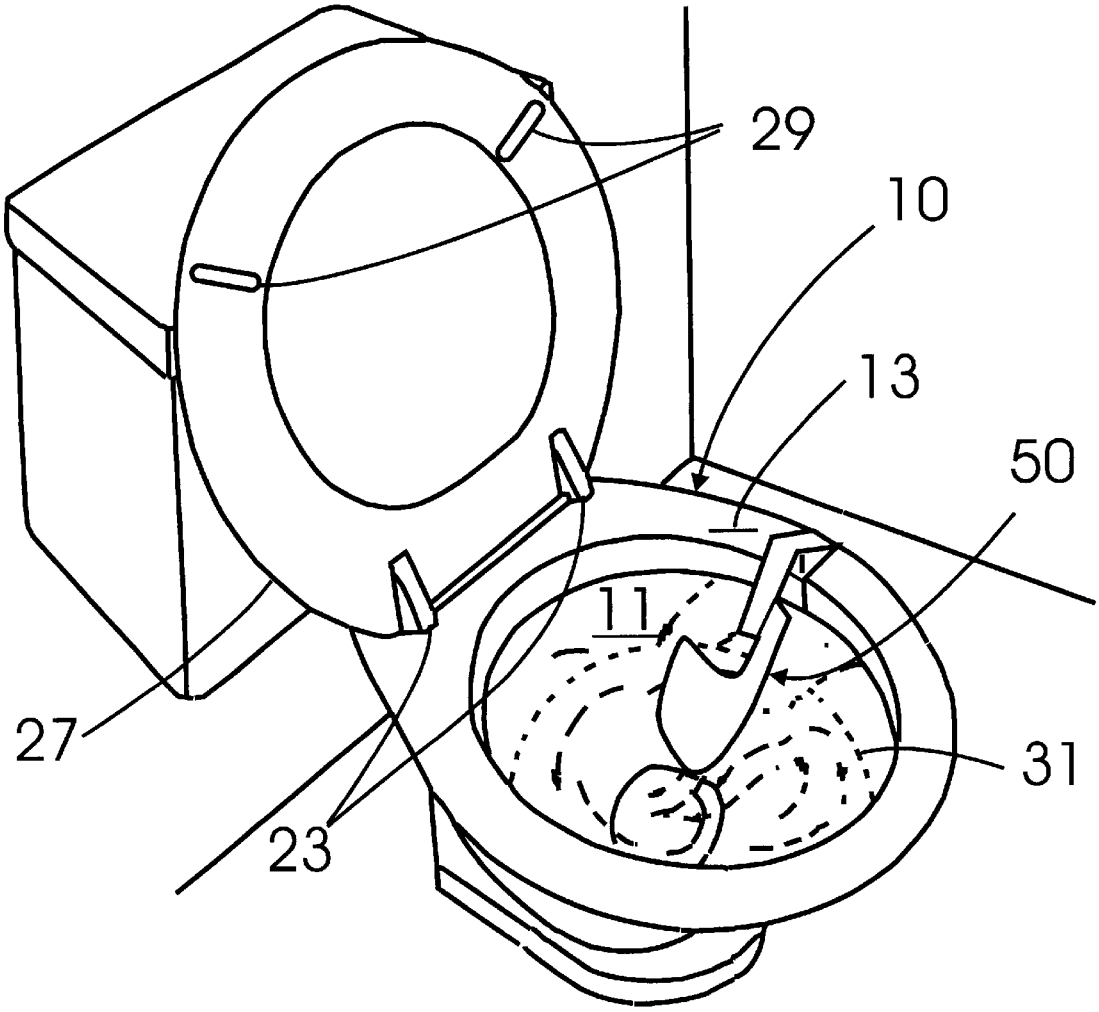
FIG. 1 shows a household toilet with the splatter shield of this invention installed.

Turning first to FIG. 1, a typical household toilet 10 in which the toilet shield 50 will be used is illustrated. The toilet 10 has a bowl 11 with an upper rim 13. The seat 27 is held in horizontal position parallel to the rim 13 of the toilet 10 by the posts 23 and by bumpers 29 on the underside of the seat proximate its forward end. In its normal condition, the bowl 11 stores water at a threshold standing water level 31. In the flushing operation of the toilet 10, water inlet to the bowl 11 raises the water level above the threshold level 31 before the contents of the bowl 11 are discharged through the waste system (not shown) and the water level is again returned to its threshold level 31. In FIG. 1, the seat 27 is shown in its up position, angularly displaced away from the rim 13 of the toilet 10.

Figure 2:
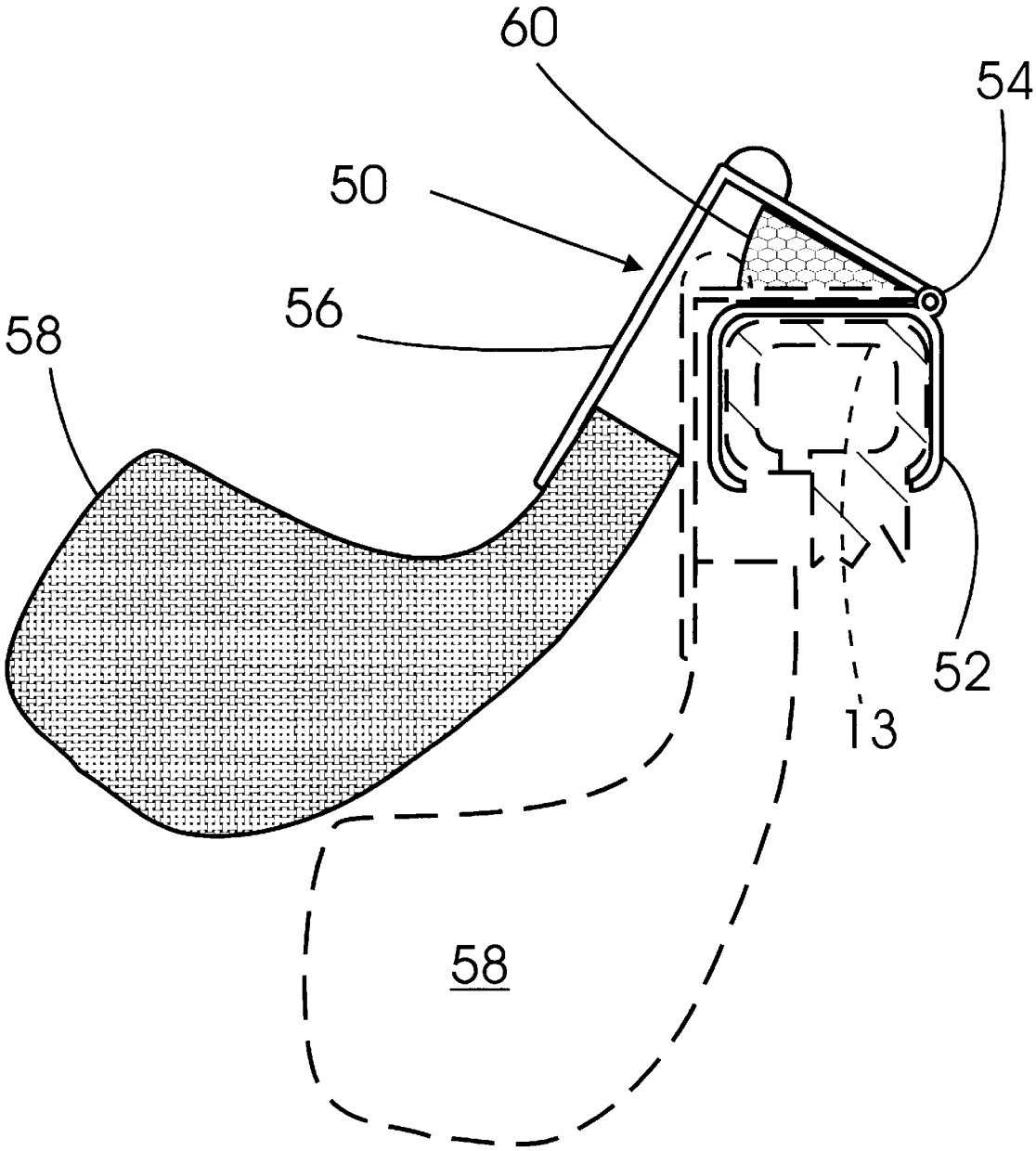
FIG. 2 shows detail of the splatter shield of this invention in its use and non-use positions.

Attached to the rim of the toilet is the splatter shield 50, shown in detail in FIG. 2. FIG. 2 shows the rim of the toilet in cross-section and shows the splatter shield of this invention attached thereto. A C-shaped flat clip 52 is adapted to grip the rim 13 of the toilet bowl at one side thereof. This clip may be held in place by spring pressure, by screw clamps, or by adhesives. The top surface of this clip is substantially flat, paralleling the top surface of the toilet rim. At the outboard edge of this clip is a hinge 54 supporting a spring-biased lever 56 that extends inward and downward into the bowl of the toilet, supporting on the distal end thereof a strike pad 58 for absorbing the impact of a urine stream impinging upon it, reducing noise and reducing splatter. In the drawing, the strike pad 58 is shown as a woven screen-like material. In practice the pad 58 can be a smooth or textured substantially planar surface or it could have a non-woven mat surface, the better to break up the impinging urine stream and absorb energy therefrom. The lever 56 is shown in its raised, use position and the same lever is shown in phantom in its non-use or stored position 56'. A compressive biasing means 60 between the lever 56 and the clip 52 raises the lever to the use position and supports it there in cooperation with the hinge 54. When the toilet seat is lowered, the bottom of the seat impinges upon the top surface of the hinge, forcing it downward, compressing the biasing means and moving the splatter shield close to the inside surface of the toilet bowl, into its non-use position.

The lever 56 is engagable against the underside of the seat for downward displacement of the lever and thus the strike pad 58 in response to force exerted on the lever by the underside of the seat during rotation of the seat into the down position. In this non-use position, the strike pad 58 is close to the wall of the bowl, but above the normal water level therein. When the toilet is flushed, however, the water level rises to rinse the strike pad 58 of any residual urine. Some of the flushing water comes from within the rim of the bowl and may add to this cleansing action.

The biasing means 60 is preferably a wedge of open-celled elastomeric foam. Such foams can be made with anti-bacterial and anti-fungicidal agents in the material of the foam itself.

Other compression biasing means may be used. A simple coil spring could be used, for instance. A leaf spring could be used. A leaf spring could be molded into the C-shaped clip or into a portion of the lever. In fact, the entire invention could be molded in a single process, creating a leaf spring in the process and creating a so-called "living hinge" joining the lever with the C-shaped clip.

Thus, it is apparent that there has been provided, in accordance with the invention, a toilet bowl shield that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A splatter shield adapted to be mounted on the rim of a toilet, said toilet comprising a toilet bowl with a rim and a seat hinged for rotation between a down position on the rim of the toilet bowl and an up position angularly displaced from the rim of the toilet bowl, said shield comprising:

a clip adapted to engage the rim of a toilet a hinge means at the outboard edge of said clip a lever attached to said hinge and extending inward and downward into the bowl of said toilet said lever supporting a strike pad for absorbing the impact of a liquid stream impinging upon it said lever biased by a biasing means to rise away from said clip, thereby raising said pad to a use position said lever engageable against the underside of said seat to compress said biasing means when said seat is in a down position, thereby to move said pad to a non-use position within the bowl of said toilet.

2. The splatter shield of claim 1 wherein said biasing means comprises a wedge of elastomeric foam.

3. The splatter shield of claim 2 wherein said foam is an open-celled foam.

4. The splatter shield of claim 1 wherein said strike pad comprises a woven screen.

5. The splatter shield of claim 1 wherein said strike pad is a solid, planar surface.

* * * * *